United States Patent [19]

Sexton et al.

[11] Patent Number: 4,659,252

[45] Date of Patent: Apr. 21, 1987

[54] RCC DAM CONSTRUCTION AND METHOD

[75] Inventors: Donald L. Sexton; Ronald L. Hurt, both of Lexington, Ky.; Richard G. Lewis, Rte. 5, Winchester, Ky. 40391

[73] Assignees: Parrott, Ely and Hurt Consulting Engineers, Inc., Lexington; Palmer Engineering Company; Richard G. Lewis, both of Winchester, all of Ky. ; a part interest

[21] Appl. No.: 772,323

[22] Filed: Sep. 4, 1985

[51] Int. Cl.[4] ..... E02B 7/02

[52] U.S. Cl. ..... 405/109; 405/107; 405/116

[58] Field of Search ..... 405/107–117; 52/169.7, 169.8

[56] References Cited

U.S. PATENT DOCUMENTS

| | | | |
|---|---|---|---|
| 1,863,205 | 6/1932 | Noetzli | 405/116 X |
| 1,879,430 | 9/1932 | Noetzli | 405/116 |
| 2,752,774 | 7/1956 | Steinboeck | 405/117 |
| 4,090,363 | 5/1978 | List et al. | 405/109 |
| 4,207,017 | 6/1980 | Jarrell | 405/270 |

OTHER PUBLICATIONS

"Roller-Compacted Concrete Bid Way Low at BuRec Dam", ENR, 11/3/83.

Specification drawing of Winchester Municipal Utilities Dam Project (sheet 15 of 30), 11/83.

*Primary Examiner*—Dennis L. Taylor

*Attorney, Agent, or Firm*—King and Schickli

[57] ABSTRACT

A dam structure for retaining water in a reservoir includes precast concrete panel assembly forming the face or upstream side. A bonded impervious liner means, such as polyvinylchloride sheet, is provided on the downstream face of the precast concrete panels assembly. The liner means includes individual membranes bonded to adjacent panels, and heat welded impervious strips are provided along the joints between the panels. A poured concrete curtain wall is provided adjacent the liner means of the precast concrete panel assembly. Roller compacted concrete (RCC) is then provided in layers on the downstream side of the poured concrete curtain wall. An elongated, substantially horizontal blocking sheet of polyvinylchloride membrane is also provided at least adjacent the base of the dam to prevent water migrating upward through the dam between the precast concrete panels and the poured concrete curtain wall. The broadest aspect of the method of constructing a dam according to the invention includes the steps of erecting a tier of concrete panels to form a dam face; pouring a layer of concrete adjacent and downstream of the concrete panels to form a curtain wall; spreading a layer of roller compacted concrete adjacent and downstream of the curtain wall; and repeating each of these steps until a dam of the desired height is completed.

20 Claims, 2 Drawing Figures

RCC DAM CONSTRUCTION AND METHOD

TECHNICAL FIELD

The present invention relates generally to dam structures or the like and to an improved method of constructing a dam for retaining water in a reservoir.

BACKGROUND OF THE INVENTION

Up until recently, dams forming lakes and reservoirs typically fell within two general categories of construction. These categories are rock and earth fill dams and conventional poured mass concrete dams.

Earth or rock filled dams are less expensive than conventional mass concrete dams. Earth and rock filled dams, however, suffer substantial disadvantages. For example, earth and rock filled dams cannot withstand "over topping" of the water, as this obviously causes erosion of the dam structure. Thus, earth and rock filled dams must be filled higher than otherwise would be required, dramatically boosting the volume of the fill, and leading to a dam of excessively thick cross section and larger aerial extent. A separate spillway must be constructed to release excess water, particularly during flood conditions. The end result is that this type of dam structure, especially for impounding larger bodies of water, is relatively expensive to build.

In addition, earth and rock filled dams are prone to leakage as the water tends to weep through interstices in the structure. As a result, grouting procedures and other stop-gap devices, such as continuous plastic liner, must be utilized to make the dam retain enough water to keep the lake full. Periodic regrouting and other leakage preventive maintenance must be carried out. As can be readily seen, the overall cost of this type of dam is thus further increased, rather dramatically.

Conventional poured mass concrete dams advantageously are of narrower cross section and of less aerial extent. Also, leakage is not as great a problem. However, using poured concrete for the entire structure with the attendant forms and finish work required is considerably more expensive and time consuming.

Recently, dams are being constructed of roller compacted concrete (RCC), a damp gravel fill blended with cement and compacted by rolling in layers behind a precast concrete panel assembly. Advantageously, unlike rock fill dams, RCC dams can withstand over topping during flood conditions. Further, they can be built with the same narrow cross section and low aerial extent as mass concrete dams.

RCC dam also has many advantages over conventional poured mass concrete dams. Specifically, roller compacted concrete mixing requirements are less stringent requiring both less concrete and allowing a wider range of aggregates to be used in the mix. Thus, local aggregates often can be used at cost savings not available with conventional poured concrete. Roller compacted concrete dams also require less labor than conventional mass concrete dams as there is relatively little forming and the concrete is spread by highway scrapers rather than bucket by bucket. Advantageously, these characteristics result in roller compacted concrete dams of comparable strength costing as much as one third less and built in as much as one third the time as conventional poured mass concrete dams.

Despite all of these advantages, prior art roller compacted concrete dams still suffer from some problems that must be addressed and solved. Specifically, the roller compacted concrete is spread in substantially horizontal layers to form the dam. This typically creates a weak plane along the horizontal cold joints between layers that can eventually allow the passage of water. As the water leaks in these planes, the enormous static head pressure can actually provide sufficient lifting force to cause parts of the dam to uplift or slide. Further, during winter months, the water trapped between the roller compacted concrete layers near the surface of the dam may freeze and expand placing further pressure on the cold joints and possibly increasing the leak flow rate over time. Eventually, this could result in an unstable condition and the need for costly dam repairs.

It, therefore, is clear that a need exists for an improved dam structure and method of construction appreciably limiting or eliminating water leakage through the roller compacted concrete dam.

SUMMARY OF THE INVENTION

Accordingly, a primary object of the present invention is to provide a dam structure and method of dam construction substantially overcoming the above-described limitations and disadvantages of the prior art.

Another object of the present invention is to provide a strong and safe dam structure of the roller compacted concrete (RCC) type that may be quickly and easily constructed at a relatively low cost.

A further object of the present invention is to provide a layered RCC dam with improved leak resistance substantially reducing the tendency for uplift pressure along the layers throughout the dam and thereby improving the overall structural integrity of the dam.

Additional objects, advantages and other novel features of the invention will be set forth in part in the description that follows and in part will become apparent to those skilled in the art on examination of the following or may be learned with the practice of the invention. The objects and advantages of the invention may be realized and attained by means of the instrumentalities and combinations particularly pointed out in the appended claims.

To achieve the foregoing and other objects and in accordance with the purposes of the present invention as described herein, an improved dam structure is provided and utilized for retaining water in a reservoir, especially small to medium size reservoirs. The dam structure includes an upstream side of precast concrete panels assembled in edge-to-edge contact and directly retaining the water in the reservoir. The precast concrete panels include a bonded impervious liner means. A concrete curtain wall of conventional poured concrete is formed adjacent the precast concrete panels adjacent to the liner means. Layers of RCC are spread adjacent the poured concrete curtain wall to complete the dam.

Preferably, the waterproof liner means includes individual plastic membranes corresponding to the precast concrete panels. The membrane side of the panel assembly is on the downstream side, that is on the face of the panels away from the reservoir water. Thus, when the dam is completed, the liner is positioned between the precast concrete panels and the poured concrete curtain wall. With this arrangement, the membranes are substantially isolated and thus protected from ambient conditions.

The waterproof membranes may be made of any appropriate impervious material, such as a polyvinylchloride membrane. The membranes of adjacent precast concrete panels are connected by membrane strips heat welded to seal the panel assembly along the joints.

The poured concrete curtain wall and RCC is formed in substantially horizontally extended layers. Each section of the curtain wall is poured so as to form a smooth composite surface to back up the liner means resisting the hydraulic pressure on the face of the panel assembly. The RCC layers mate with the concrete sections and form a downstream face inclined at approximately 45°.

At least one elongated membrane sheet, also of polyvinylchloride, extends continuously across the dam adjacent the bottom. This membrane sheet extends horizontally or laterally outwardly from the panel assembly and is heat welded to seal against the bonded liner of the precast concrete panels. This membrane sheet blocks or prevents the migration of water upwardly between the precast concrete panels and the poured concrete curtain wall. Preferably, the blocking sheet is located in the poured concrete sleeper slap in the keyway of the dam. While the problem of upward water migration exerting uplift pressures on the dam structure is greatest adjacent the base of the dam, additional blocking sheets can be provided in the layered RCC portion of the dam structure, if desired.

In accordance with a further aspect of the present invention, a novel method of constructing a new RCC dam is also provided. The method includes the step of erecting a tier of precast concrete panels to form a dam face. Next is the step of pouring a layer of concrete adjacent and behind the precast concrete panels to form a curtain wall. A layer of RCC is then spread and compacted adjacent and behind the poured curtain wall to complete the cross section extent of the dam. Each of these steps is repeated until the desired height of the dam is obtained.

Additional and more specific steps of the method include the sealing of the precast panels against water penetration by including a bonded impervious liner membranes on adjacent panels and welding a sealing strip along the joints between adjacent precast concrete panels.

Preferably, the method of construction also includes the steps of adding an elongated blocking sheet along the base of the dam to prevent upward water migration.

Still other objects of the present invention will become readily apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modifications in various, obvious aspects all without departing from the invention. Accordingly, the drawing and descriptions will be regarded as illustrative in nature and not as restrictive.

BRIEF DESCRIPTION OF THE DRAWING

The accompanying drawing incorporated in and forming a part of the specification, illustrates several aspects of the present invention, and together with the description serves to explain the principles of the invention. In the drawing.

Reference will now be made in detail to the present preferred embodiment of the invention, an example of which is illustrated in the accompanying drawing.

DETAILED DESCRIPTION OF THE INVENTION

Figure 1:
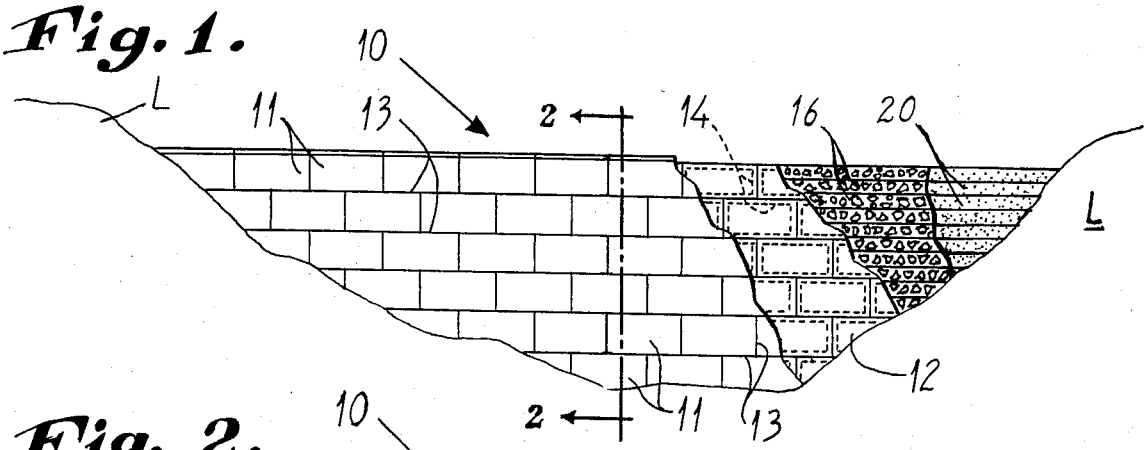
FIG. 1 is a cutaway upstream face view of a dam constructed in accordance with the teachings of the present invention.

With reference now to FIG. 1, the improved RCC dam structure 10 includes a plurality of tiered precast facing panels 11 arranged in an edge-to-edge assembly. A typical contour of land L is shown to illustrate the preferred embodiment and with the panels 11 adjacent the land being stairstepped along the contour in a normal fashion. A keyway K formed in the ground G defines a poured concrete (bedding mix) sleeper slab S along substantially the full length of the dam 10 (see FIG. 2).

As clearly illustrated in FIG. 1, the precast concrete panels 11 face upstream and, thus, the water in the reservoir directly contacts the exposed concrete panel faces.

Bonded to the rear or downstream side of the facing panels 11 is an impervious liner means, taking the form in the preferred embodiment as individual membranes 12. Preferably, the membranes 12 are placed in the bottom of the precast molds with T-shaped locking members sticking up for embedding directly into the panels 11. For example, the liner membranes may be a 65-mil polyvinylchloride (PVC) material sold under the trade name AMER-PLATE by Ameron, 201 North Berry Street, Brea, Calif. 92621, or equivalent.

Figure 2:
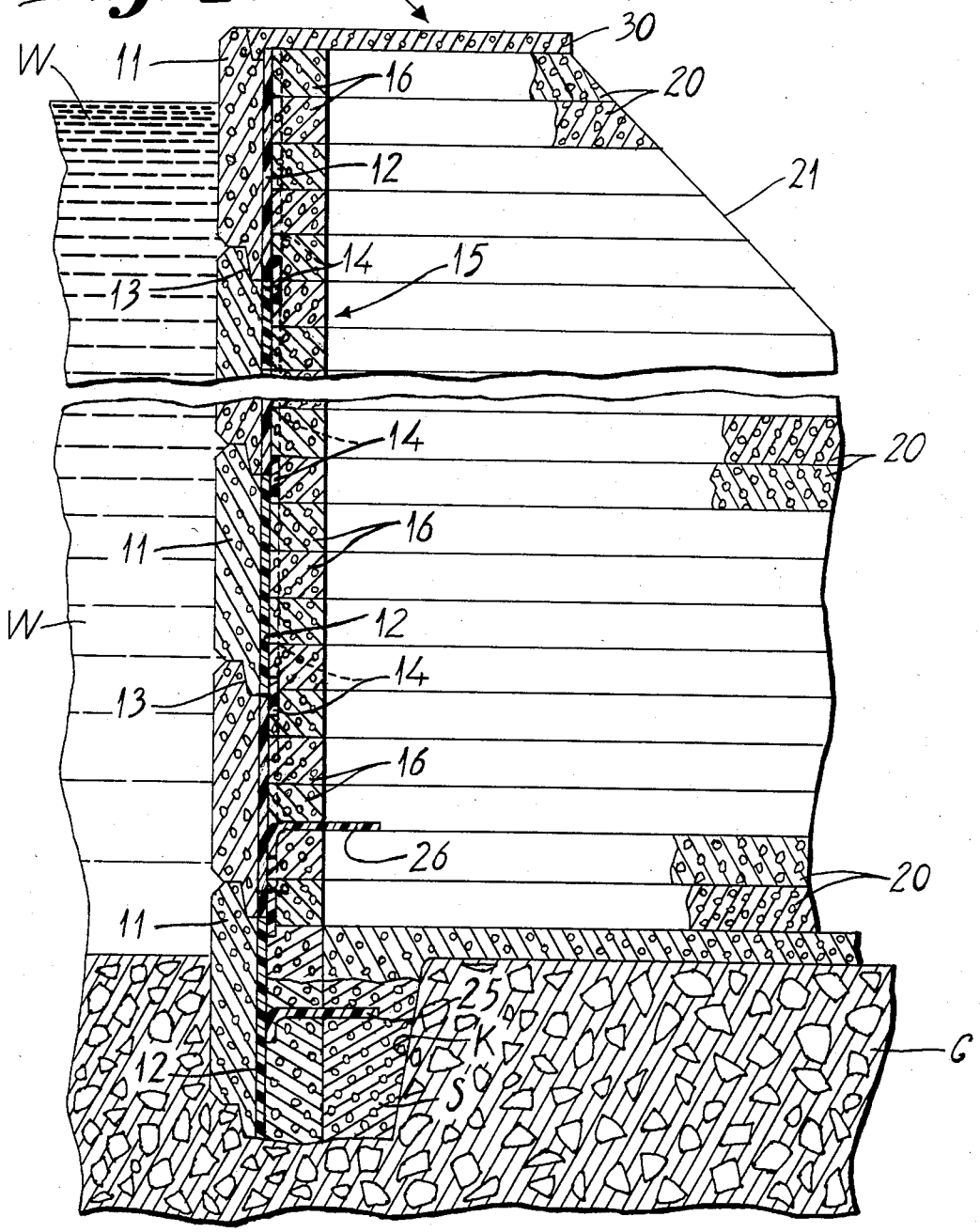
FIG. 2 is a cross section of the dam taken along line 2—2 of FIG. 1.

The panels 11 are assembled by positioning in substantially vertical load bearing engagement along shiplap joints 13, as best shown in FIG. 2. Extending along each of the joints is a sealing strip 14, also preferably of PVC material. The strips 14 cover the horizontal joints (see FIG. 2), and also the vertical joints, as shown in the cutaway section of FIG. 1. The sealing strips 14 are heat sealed to the membranes 12, thus rendering a totally impervious barrier to water W in the reservoir.

The heat welding of the strips 14 in place can be by conventional techniques wherein the source of heat is applied to the exposed face of said strips. As the plastic material is heated adjacent the joint 13, the PVC plastic is softened and with pressure the two parts are permanently joined. The heating and pressure are controlled so that an optimum sealed relationship between the strips 14 and the membranes 12, as well as between the butt joint of adjacent membranes 12, is obtained.

A concrete curtain wall, generally designated by the reference numeral 15, is formed in layers or lifts 16 in juxtaposition to the composite liner of membranes 12 and sealing strips 14 (see FIG. 2). Poured concrete, such as bedding mix concrete, has been found to be ideal for this purpose. In particular, the poured concrete provides a rigid or solid face against which the membranes 12 are pushed by the hydraulic pressure of the water W in the reservoir. With this arrangement, the liner membranes 12 can not be lifted and separated from the panels 11 by the hydraulic pressure, particularly acting in the region of the sealing strips 14 along the joints 13. The liner is advantageously positioned between the precast concrete panels 11 and the solid curtain wall 15 providing substantial isolation from ambient conditions. The integrity of the liner, including both the panel membranes 12 and the sealing strips 14, is also fully protected at all times.

Next to each lift 16 of the curtain wall 15 is provided the roller compacted concrete (RCC) layers or lifts 20. As is known and depicted by the cutaway view of FIG. 2, the layers 20 project outwardly to the greatest extent at the base of the dam 10, progressively getting shorter at the top of the dam 10. The sloping downstream face 21 of the dam extends at an approximately 45° angle, or a one on one slope.

As best illustrated in FIG. 2, the poured concrete curtain wall lifts 16 and the RCC layers 20 extend substantially horizontally with respect to ground G. As each lift of the curtain wall is poured, it forms an extension of the smooth, solid surface to back up the liner means. The corresponding RCC layers 20 are spread along the surface of each previous layer, and then compacted so as to form a substantially unitary structure with each respective lift 16.

At least one elongated impervious sheet 25, preferably of polyvinylchloride plastic, is embedded in the keyway K and extends continuously across the dam to form a blocking flap. The membrane sheet 25 extends substantially horizontally out away from the panel assembly, as best shown in FIG. 2. The sheet 25 is sealed to the lower most portion of the liner by heat welding. This relationship effectively blocks or prevents the migration of water upwardly between the precast panels 11 and the curtain wall 15. If desired, an additional blocking sheet 26 can be positioned in the layered curtain wall lifts 16 and RCC layers 20.

Considering now the method of constructing the RCC dam of the present invention, the first step is erecting a tier of precast concrete panels to form the dam face. Secondly, a lift of poured concrete adjacent and downstream of the precast concrete panels is provided forming a curtain wall 15. Next, a layer 20 of RCC is spread and compacted adjoining the curtain wall 15. Thereafter, these steps are repeated until the dam has been built to its desired height.

In addition, there is a step of bonding individual impervious membranes 12 to the panels 11 before they are erected in edge-to-edge engagement. Impervious strips 14, preferably of the same material as the membranes 12, are heat welded to the membranes along the joints 13, thereby forming a totally impervious barrier. An elongated blocking sheet, also of impervious material is extended horizontally from the downstream side adjacent the base of the dam. This sheet runs along the full length of the dam essentially following the contour of the ground G. It is also important to the method to heat weld the blocking sheet to the PVC membranes 12.

If desired, a concrete slab cap 30 may be positioned on top of the dam 10.

In summary, applicant has provided an improved RCC dam structure wherein leakage is eliminated, and the dam 10 can be built at minimum cost. Individual PVC membranes 12 are bonded to the panels 11 to form a liner. The joints 13 are fully sealed by the sealing strips 14. A curtain wall 15 is poured in lifts to back up the liner. RCC layers 20 are applied to correspond to each concrete lift 16, and thus complete the basic improved structure. In addition, however, blocking sheet 25 forms a horizontal flap preventing water from migrating between the panels 11 and the curtain wall 15. The sheet 25 can be most advantageously positioned in the sleeper slab S, but also other blocking sheets 26 may be incorporated.

The foregoing description of a preferred embodiment of the invention has been presented for purposes of illustration and description. It is not intended to be exhaustive or to limit the invention to the precise form disclosed.

We claim:

1. A dam structure or the like for retaining water in a reservoir, comprising:

precast concrete panels assembled in substantially vertical load bearing engagement and including an impervious and substantially continuous liner means;

a poured concrete curtain wall adjacent and downstream of said precast concrete panels, said liner means being in juxtaposition to said curtain wall; and roller compacted concrete adjacent said poured concrete curtain wall.

2. The dam structure of claim 1, wherein said precast concrete panels directly contact the water in the reservoir.

3. The dam structure of claim 1, wherein said liner means is bonded to the downstream face of said panel means.

4. The dam structure of claim 3, wherein said liner means comprises individual membranes corresponding to said panels.

5. The dam structure of claim 4, wherein the bonded individual membranes of the precast concrete panels are connected by strips heat welded to seal said precast concrete panels along the joints.

6. The dam structure of claim 1, wherein said impervious liner means includes individual membranes bonded on the face of each precast concrete panel.

7. The dam structure of claim 6, wherein the bonded individual membranes of the precast concrete panels are connected by strips heat welded to seal said precast concrete panels along the joints.

8. The dam structure of claim 7, wherein said membranes and strips are polyvinylchloride.

9. The dam structure of claim 8, wherein said membranes are bonded to the downstream side of said panels.

10. The dam structure of claim 9, wherein said membranes and welded sealing strips are positioned between said concrete panels and the poured concrete curtain wall so as to be isolated from ambient conditions.

11. The dam structure of claim 1, wherein said poured concrete curtain wall and roller compacted concrete are formed in substantially horizontally extending layers.

12. The dam structure of claim 11, wherein blocking means are provided for preventing migration of water upwardly between said precast concrete panels and said poured concrete curtain wall at least adjacent the base of the dam.

13. The dam structure of claim 12, wherein said blocking means is an elongated impervious sheet extending along the dam.

14. The dam structure of claim 13, wherein said impervious sheet forms a flap extending in a substantially horizontal plane between two layers of said poured concrete curtain wall.

15. The dam structure of claim 14, wherein said liner means and said sheet are polyvinylchloride membranes.

16. The dam structure of claim 15, wherein said liner membrane is bonded to said precast concrete panels and said sheet membrane is heat welded to said liner membrane along the length.

17. A method of constructing a dam or the like for retaining water in a reservoir, comprising the steps of:

a. erecting a tier of substantially vertical load bearing precast concrete panels to form a dam face for subsequently contacting water in the reservoir; providing an impervious liner;

b. pouring a layer of concrete adjacent and downstream of said precast concrete panels to form a curtain wall;

c. spreading and compacting a layer of roller compacted concrete adjacent and downstream of said poured layer of concrete;

d. repeating steps a–c until the dam is completed.

18. The method of constructing a dam of claim 17, including the additional step of forming the impervious liner by bonding individual impervious membranes to said panels before erection, and heat welding impervious strips to adjacent membranes along the joints.

19. The method of constructing a dam of claim 18 including the additional step of adding an elongated blocking sheet of impervious material extending horizontally from the downstream side adjacent the base of the dam.

20. The method of constructing a dam of claim 19 including the step of heat welding said blocking sheet to the membranes of said precast concrete panels.

* * * * *